US011311119B2

(12) United States Patent
Durham et al.

(10) Patent No.: US 11,311,119 B2
(45) Date of Patent: Apr. 26, 2022

(54) QUICK ASSEMBLY STACKING DISPLAY CASE

(71) Applicant: Brass Reminders Company, Inc., Keene, KY (US)

(72) Inventors: Brent Durham, Keene, KY (US); Thomas Alexander Montgomery, Lexington, KY (US)

( * ) Notice: Subject to any disclaimer, the term of this patent is extended or adjusted under 35 U.S.C. 154(b) by 68 days.

(21) Appl. No.: 17/066,045

(22) Filed: Oct. 8, 2020

(65) Prior Publication Data

US 2021/0401191 A1 Dec. 30, 2021

Related U.S. Application Data

(60) Provisional application No. 63/044,611, filed on Jun. 26, 2020.

(51) Int. Cl.

| | |
|---|---|
| ***A47F 3/00*** | (2006.01) |
| ***A47B 87/02*** | (2006.01) |
| ***A47F 3/14*** | (2006.01) |

(52) U.S. Cl.

CPC ..... *A47F 3/004* (2013.01); *A47B 87/0269* (2013.01); *A47F 3/14* (2013.01)

(58) Field of Classification Search

CPC ..... A47B 87/0253; A47B 87/0261; A47B 87/0269; A47B 87/0276; A47B 87/0284; A47B 87/0292; A47F 3/004; A47F 3/14

See application file for complete search history.

(56) References Cited

U.S. PATENT DOCUMENTS

| | | | | | |
|---|---|---|---|---|---|
| 1,951,972 | A * | 3/1934 | Fraser | A47B 87/0261 | 206/821 |
| 2,506,844 | A * | 5/1950 | Smith | A47B 87/02 | 211/1 |
| 3,529,878 | A * | 9/1970 | Blowers | A47B 87/0292 | 312/107 |
| 3,862,689 | A * | 1/1975 | Taub | A47F 5/116 | 211/126.2 |
| 3,974,898 | A * | 8/1976 | Tullis | A45C 7/0045 | 312/111 |
| D316,643 | S * | 5/1991 | Cheetham | D6/675.1 | |
| D331,844 | S * | 12/1992 | Rover | D6/680.2 | |
| 5,253,767 | A * | 10/1993 | Koeppel | A47F 7/146 | 211/144 |
| 5,984,120 | A * | 11/1999 | Johnske | A47F 5/116 | 211/132.1 |
| 9,826,843 | B1 * | 11/2017 | Tomaszewski | A47B 87/0253 | |
| 2015/0320207 | A1 * | 11/2015 | Chan | B65D 21/0212 | 312/108 |
| 2018/0192772 | A1 * | 7/2018 | Yamamoto | A47B 88/941 | |
| 2021/0076816 | A1 * | 3/2021 | DeShon | A47B 87/008 | |

* cited by examiner

*Primary Examiner* — Matthew W Ing
(74) *Attorney, Agent, or Firm* — Michael Coblenz

(57) ABSTRACT

A four-sided stacking display case with multiple sections that can be easily assembled and disassembled. The top section has a uniform bottom attachment, the middle sections have a uniform top attachment and a uniform bottom attachment, and the bottom section has a uniform top attachment. All uniform top attachments are the same and consist of four panels attached in an offset cross pattern where each panel has a groove, and all uniform bottom attachments are the same and consist of four panels attached in an offset cross pattern where each panel has a protruding tongue, where the four tongues insert into and attach to the four grooves, so that the sections are easily attached or detached.

9 Claims, 16 Drawing Sheets

QUICK ASSEMBLY STACKING DISPLAY CASE

CROSS REFERENCE TO RELATED APPLICATIONS

This application claims priority to U.S. Application Ser. No. 63/044,611, filed on Jun. 16, 2020.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to a stacking display case that is configured for quick and easy assembly and disassembly. Specifically, the invention relates to a four-sided stacking display case with a top section, multiple middle sections, and a bottom section. Each section includes either a uniform top attachment or a uniform bottom attachment, wherein the uniform top attachment mates with and attaches to the uniform bottom attachment so that the components can be stacked and attached. The uniform bottom attachment incorporates four downwardly protruding tongues, and the uniform top attachment includes four grooves, wherein the four downwardly protruding tongues fit quickly, easily, and securely into the four grooves. This allows the stacking display case to be easily assembled. It also allows the display case to be configured to different heights by the inclusion of one or more middle sections.

Description of the Related Art

Display cases for consumer products are well known and seen in many retail stores. There are a wide variety of display case, as well as racks for displaying small consumer items on display racks. One specialty display is known as an end cap display and is placed at the end of an aisle of shelving. Often specialty items are placed in these end cap displays, and often these specialty items are uniquely sized or shaped so that they need their own special display case. One such specialty item is stickers or decals, that are often placed on the rear window of a car. These decals are flat, and typically sold in displays in stacks of the same decal. One of the most space efficient ways to display these decals is in a four-sided display case that can be easily rotated by a consumer. This allows four different decals to be displayed for sale on each level, and typically these display racks or cases have multiple levels of display bins holding decals. This allows the purchaser to stand in one spot and rotate the display case and view all of the decals for sale. One issue encountered by both retailers and the seller of specialty items, like decals, is that they are sold in specialized display cases, and so the seller or distributor has to ship the display cases. There s a need, therefore, for a display case that is easy to assemble and disassemble for shipping.

SUMMARY OF THE INVENTION

The present invention is a four-sided, multi-level stacking display case set on a turn table to allow the display case to be rotated so that all four sides to be viewed. The display case has a top section, a bottom section, and multiple middle sections that can be shipped partially disassembled and re-assembled by the end user. Each section of the display case has a uniform bottom attachment and/or a uniform top attachment that allows the components of the display case to be easily assembled and disassembled.

Each of the sections, the top section, the middle sections, and the bottom section, is made of four vertical panels that are attached to each other slightly off center to create a offset cross pattern, when viewed from above. The panels of each section have the same geometry and are attached in the same way so that the offset cross pattern of each section is the same. The top section has a uniform bottom attachment, the middle sections have a uniform top attachment and a uniform bottom attachment, and the bottom section has a uniform top attachment. The uniform bottom attachment consists of a protruding tongue on each vertical panel, and the uniform top attachment consists of a groove into each vertical panel, wherein the tongue is sized, shaped, and positioned to insert snugly into the groove. The four panels with the four tongues fit into the four panels with the four grooves below so that the sections attach. This allows the top section to be attached to the bottom section to create a low display case, of allows the inclusion of one or more middle sections to create a larger and taller display case.

DETAILED DESCRIPTION OF THE INVENTION

Detailed embodiments of the present invention are disclosed herein. It is to be understood that the disclosed embodiments are merely exemplary of the invention, and that there may be a variety of other alternate embodiments. The figures are not necessarily to scale, and some features may be exaggerated or minimized to show details of particular components. Therefore, specified structural and functional details disclosed herein are not to be interpreted as limiting, but merely as a basis for teaching one skilled in the art to employ the varying embodiments of the present invention.

Figure 1:
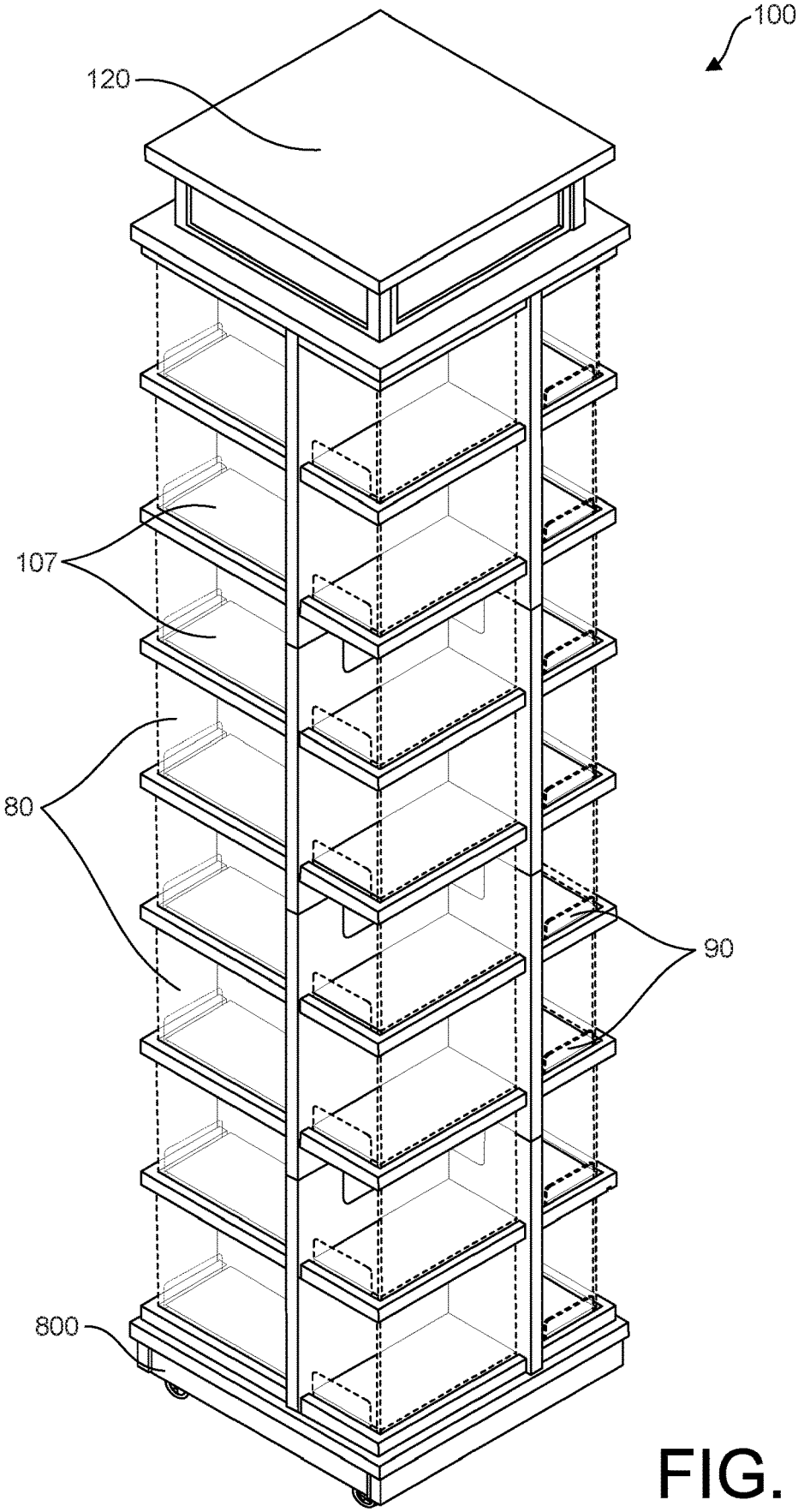
FIG. 1 is a perspective view of the fully assembled display case.
Figure 2:
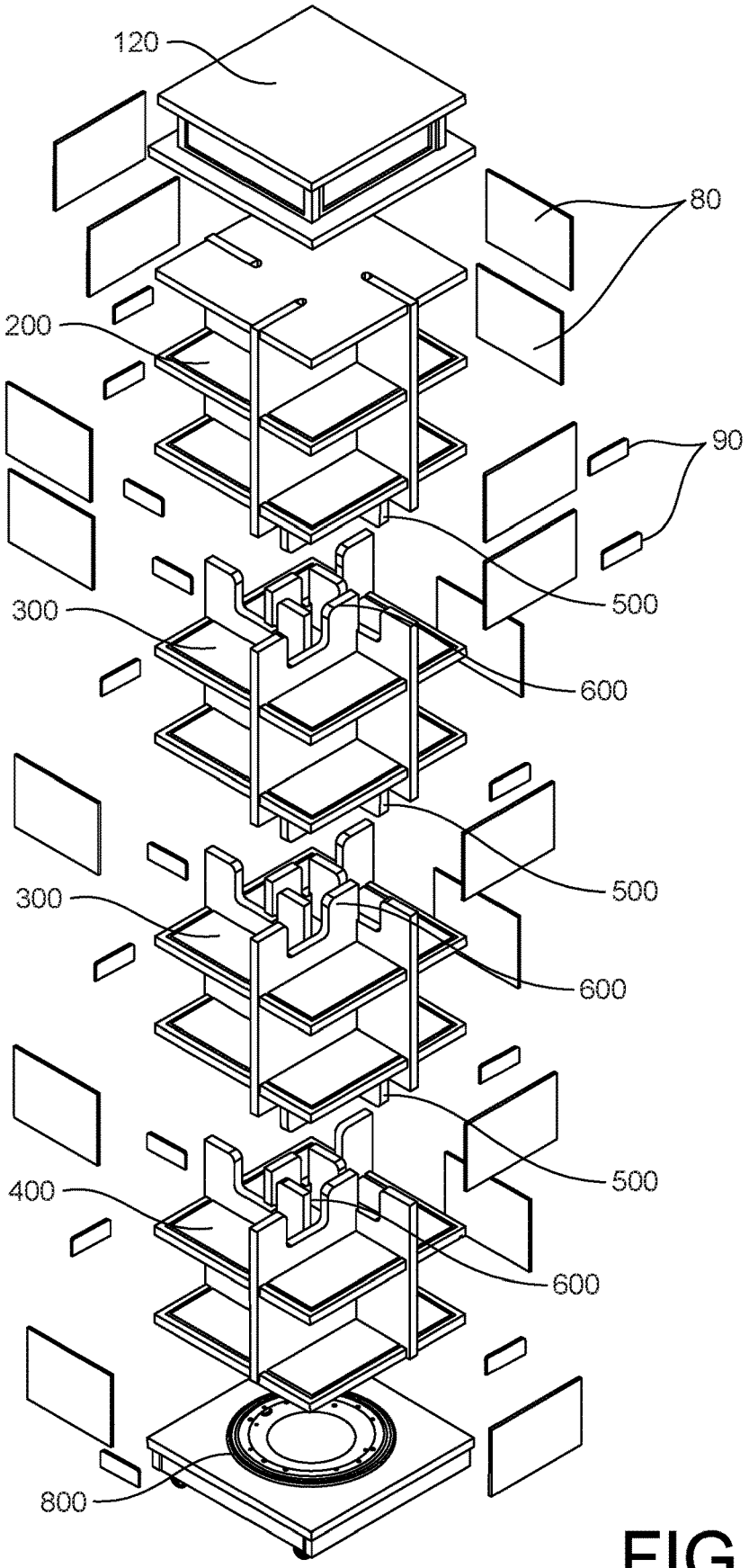
FIG. 2 is an exploded perspective view showing all of the elements of the display case.

The display case 100 is made from a number of stacking components that are designed and configured to easily attach and disassemble. This allows the display case 100 to be shipped partially disassembled and to be easily and quickly assembled by the end user, which is typically a retailer. To do so, each component has a uniform bottom attachment 500 that mates with a uniform top attachment 600 on the top of each major component. FIG. 1 shows the fully assembled display case 100, which shows that the display case 100 is four sided with multiple levels of display bins 107, with one bin 107 on each side, or four display bins 107 per level. In the preferred embodiment, shown in FIG. 1 and FIG. 2, there are eight levels of four display bins 107 per level for a total of 36 display bins. FIG. 2 is an exploded view of the display case showing the main components of the display case 100: a top section 200, which has a uniform bottom attachment 500; one or more middle sections 300, which have both a uniform bottom attachment 500 and a uniform top attachment 600; and a bottom section 400, which has a uniform top attachment 600. The display case 100 is configures so that the uniform underside attachment 500 mates with and attaches to the uniform topside attachment 600 so that the components are locked into place. In one embodiment the top section 200 is attached directly to the bottom section 400 to create a low display case having only four levels of display bins 107. In other embodiments one or more middle sections 300 are attached between the top section 200 and the bottom section 400 to create display cases of varying heights with more levels of display bins 107.

In the preferred embodiment the display case 100 sits on a turn-table base 800 that allows the display case 100 to rotate 360 degrees. The bottom section 400 has a flat bottom 480 that is configured to be set on a turn-table base 800. Such turn-tables, or Lazy-Susan, type bases are well known in the art. This turn table base 800 allows a consumer to spin the display case 100 to view all of the product in the case. In the preferred embodiment the turn table base 800 is four sided and the same size and dimensions as the display case 100 so that when it sits on the base 800 the base 800 does not extend outside of the display case 100. In one embodiment the turn-table base 800 includes wheels on the bottom so that the display case 100 can be easily moved. There is also a display topper 120 that sits on top of the top section 200. The display topper 120 is four sided and the same size as the display case 100, and allows the retail outlet to place advertising and information on the display case 100. Typically the display case 100 will hold car decals and stickers, and the retail outlet will place a sign on the topper 120 noting that the display case holds these decals and stickers. In one embodiment the display topper 120 sits on the display case 100, and the display case 100 sits on the turn table base 800, and they are held in place by gravity. In other embodiments there are attachment components such as Velcro® or other common and well known attachments.

Each component, the top section 200, middle section 300, and bottom section 400, is made up of four vertical panels and a number of horizontal elements as described in more detail below. The horizontal elements, when assembled, become the bottoms and tops of the display bins 107. Each level of the display case 100 has four display bins 107, one on each side of the display case 100, as best shown in the assembled version of FIG. 1. The display case 100 is, therefore, four sided, and has multiple levels of display bins 107. On each level the vertical panels create the two inside walls of the display bins 107, and the horizontal elements create the top and bottom of the display bins 107. There is also a bin cover 80 that creates the third outside wall of the display bin 107. The open front of the display bin 107 will, in at least one embodiment, have a small display lip 90 that will keep the contents of the display bin 107 inside.

Display topper 120 has four sides to align with and correspond to the four sides of the display case 100, and has a top and a bottom, wherein the bottom is configured to attach to the top of the top section top shelf 220. The top section top shelf 220, has four sides with four top section attachment slots 223 that are configured to allow the attachment of the attachment extension 261 of the top 260 of the vertical panels 210 to the top section shelf 220. The top shelf also has four outside bottom grooves 224 to hold the bin covers 80. The attachment slots 223 are aligned in the offset cross pattern described below to attach to the modified tops 213.

Figure 3:
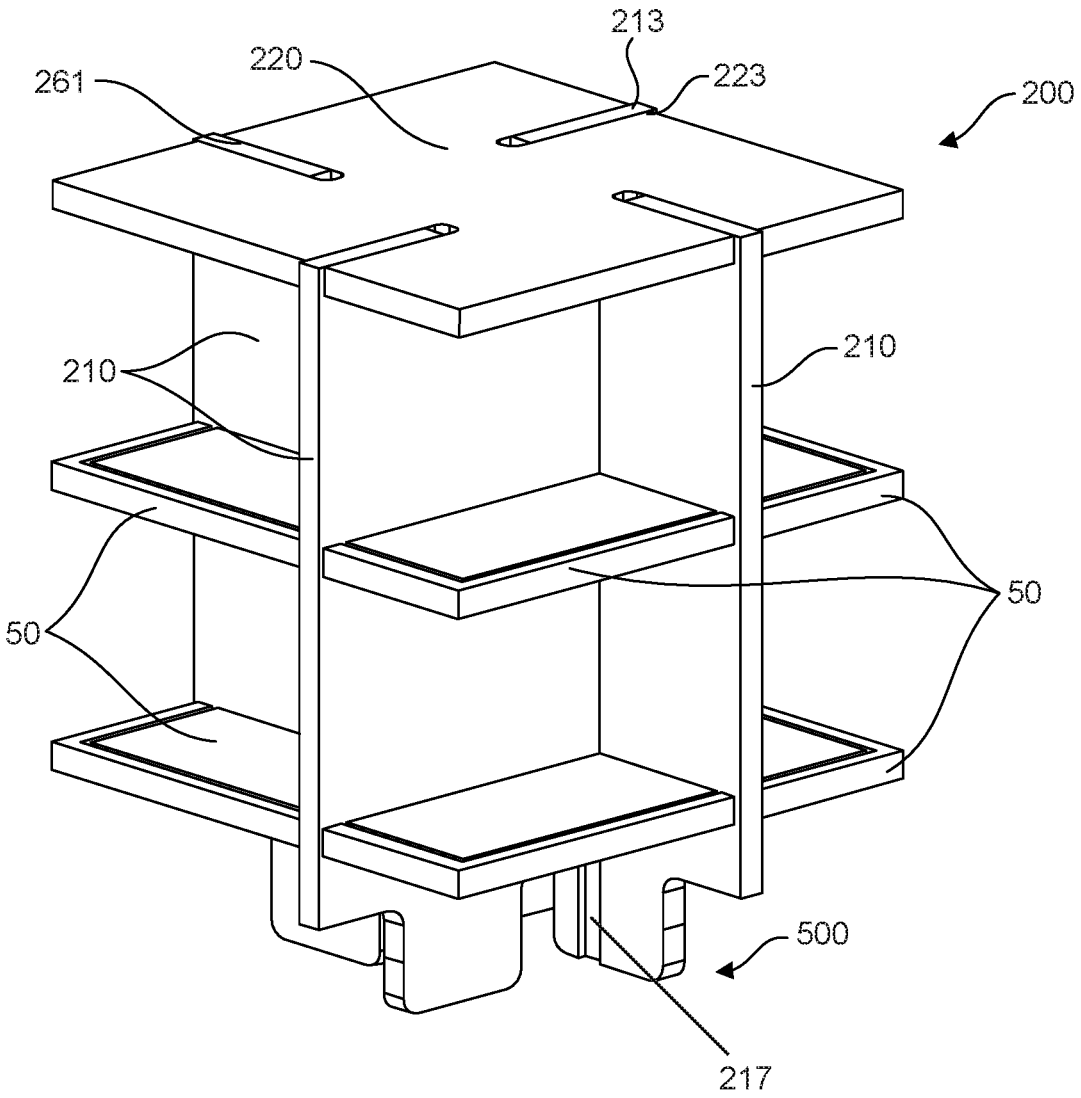
FIG. 3 is a perspective view of the top section of the display case.

As seen in FIG. 3, the top section 200 is constructed by connecting four top section vertical panels 210, a top section top shelf 220, and eight bin bases 50. In the preferred embodiment the panels and the bin base are made of standard one-inch thick wood, which has an actual thickness of approximately ¾ inch. It is possible, and within the conception of the invention for the components to be made of plastic or even a light metal such as aluminum. All of the vertical panels 210, 310, 410, bin bases 50, top shelf 220 and bottom shelf 460 are made of the same material. In the preferred embodiment that is standard one-inch thick wood.

The four top vertical panels 210 each have a vertical panel front 211 (shown in FIG. 4), a vertical panel back 212 (shown in FIG. 5), a vertical panel top 260, that is unique to the top section 200, a vertical panel bottom 250 that is part of the uniform bottom attachment 500. The vertical panel top 260 includes an attachment extension 261 that protrudes about half an inch or so above the vertical panel top 260 and is inserted into the attachment slots 223 of the top shelf 220. Each top vertical panel 210 also has a top vertical panel outside edge 218 and a top vertical panel inside edge 219. It is the vertical panel inside edge 219 that is inserted into the vertical panel attachment slot 217 as described below. In one embodiment the vertical panel inside edge 219 is the same size as the panel and the slot 217 is the same size and is configured to receive the side of the inside edge 219. In another embodiment the vertical panel inside edge 219 is cut to fit into the vertical panel attachment slot 217. Since in most embodiments the vertical panels 210 are made of wood, the inside edge 219 can be cut to size, and in one embodiment it is one-quarter (¼) inch thick and one-quarter (¼) inch deep, and the attachment slot 217 is similarly one-quarter inch wide and one-quarter inch deep. The panels are attached and held in place by the edges and slots being precisely cut so that they edges snap fit securely into the slots. In other embodiments the components are glued or attached by common adhesives. This applies for all of the attachments between edges and slots described herein.

Figure 4:
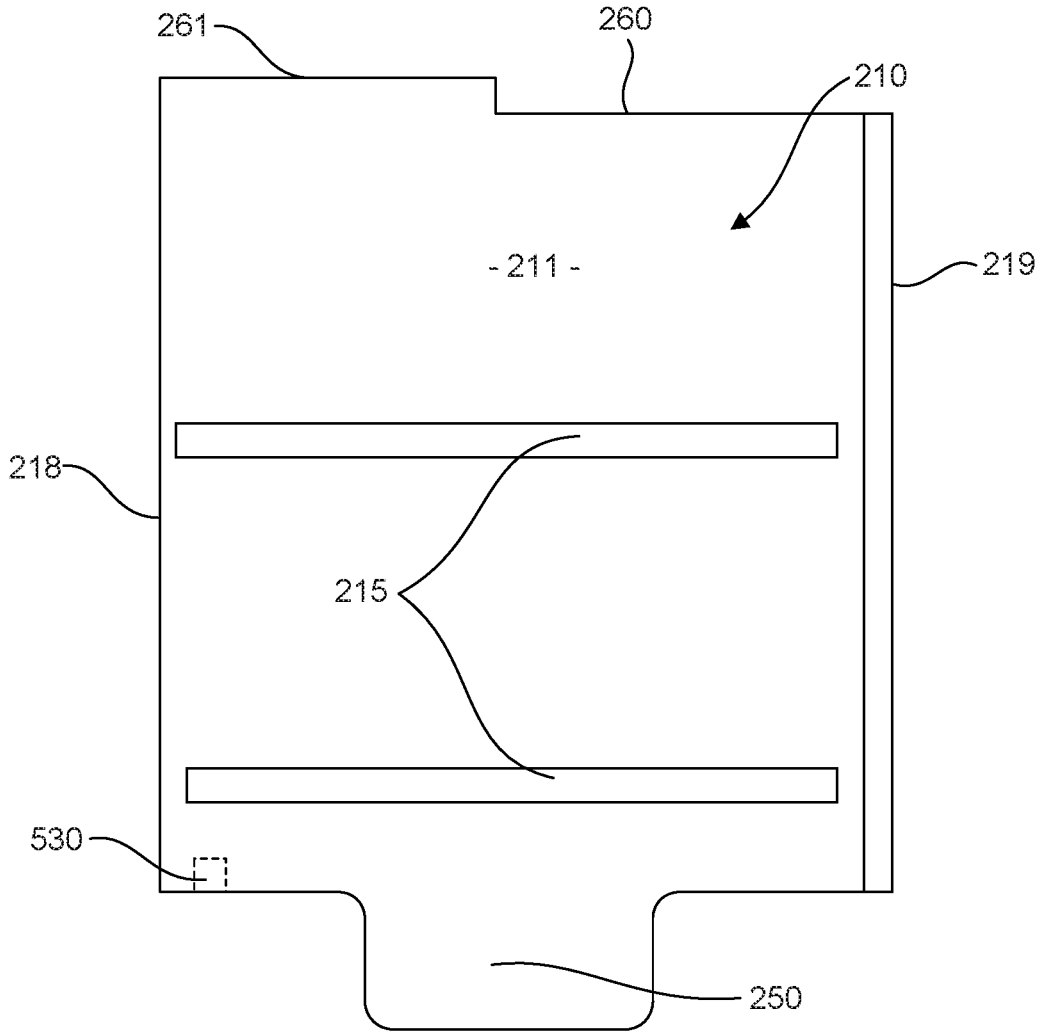
FIG. 4 is a plan view of the front of the top vertical panel.

As shown in FIG. 4, the vertical panel front 211 has two bin base slots 215 that are parallel with each other and are perpendicular to the sides of the vertical panel 210 so that when the bin bases 50 are attached they create display bins 107 for holding the articles to be displayed, wherein the display bins 107 are horizontal. The display case 100 is designed to be set on the floor, so horizontal is used in the conventional sense, and vertical means 90 degrees off of horizontal. In the preferred embodiment the bin base slots 215 are twelve inches apart so that the display slot 107 is roughly 12 inches high. In alternate embodiments the slots 215 can be between 10 and 14 inches apart. The bin base slots 215 are cut into the vertical panels 310 and are the length of the bin base 50. In one embodiment the bin base slot 215 is the width of the bin base edge 53, but in another the bin base inside edge 53 is smaller (typically ¼ inch thick) and the slot 215 is sized and configured to accept and attach the bin base edge 53 and bin base attachment end 55 as described below. The vertical panel 210 also has a bottom dowel hole 530 drilled into the vertical panel bottom 250 offset from the outside edge 218.

Figure 5:
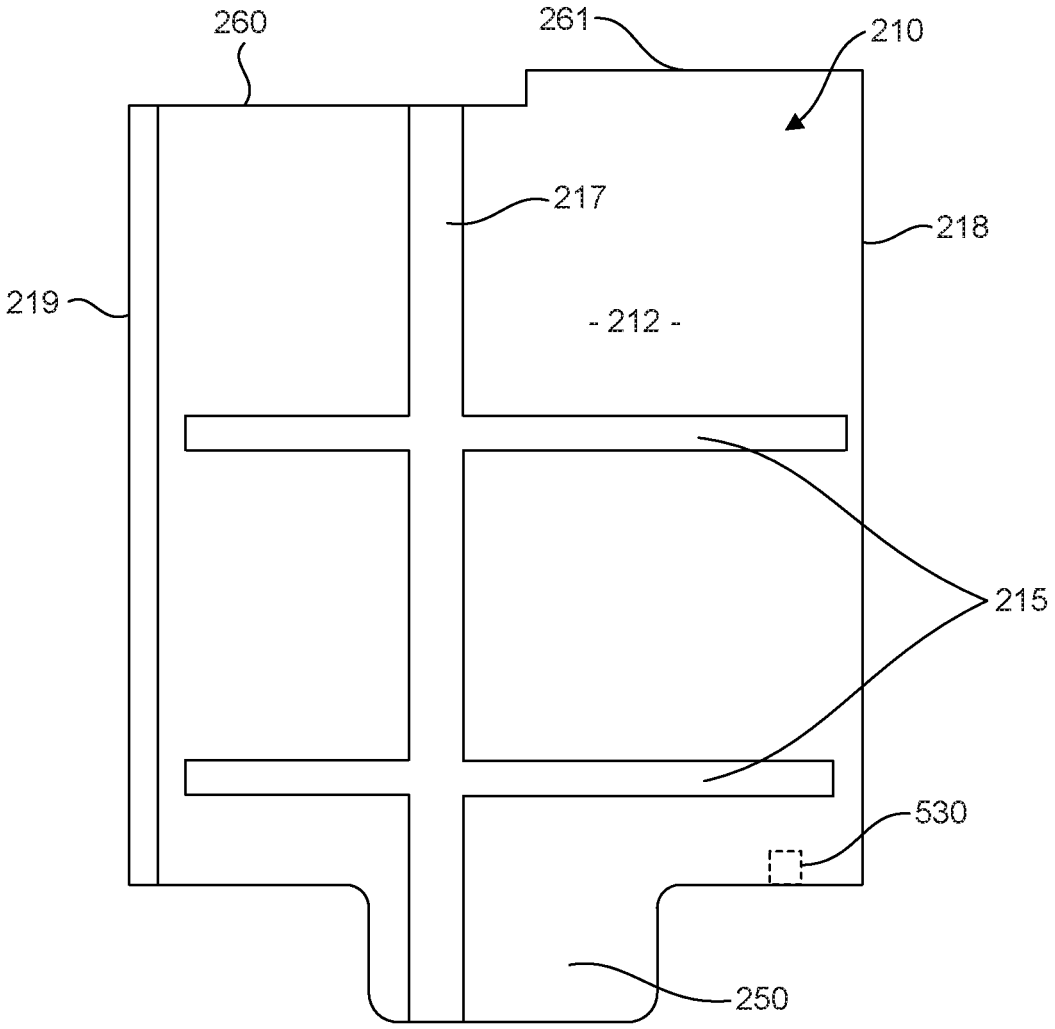
FIG. 5 is a plan view of the rear of the top vertical panel.

As seen in FIG. 5, the vertical panel back 212 also has two bin base slots 215 that correspond to the bin base slots 215 on the panel front 211 so that the bin bases 50 are attached at the same level so that the display slots 107 are planar, as seen in FIG. 1, FIG. 2 & FIG. 3. The vertical panel back 212 also has a vertical panel attachment slot 217 that runs vertically down the entire height of the vertical panel 210. The vertical panel attachment slot 217 is sized to accommodate an inserted vertical panel inside edge 219, and one quarter inch deep to securely attach the vertical panel 210. Dimensions can vary to ensure proper attachment. In one embodiment the inside edge 219 is thinner than the thickness of the panel and the slot 217 is appropriately sized and configured to accept the inside edge 219. In the preferred embodiment the vertical panel 210 (and all the vertical panels and bin bases 50) are made of wood and can easily be cut and trimmed to the appropriate size by simply milling wood at the edges. The vertical panel attachment slot 217 is offset from the middle or centerline of the middle vertical panel 210 as seen in FIG. 5. In the preferred embodiment the vertical panel 210 is 16 inches wide and the vertical panel attachment slot 217 is positioned so that the front 211 of the attached vertical panel is 8¼" from the outer edge 218 so that the display slot 107 is approximately 8 inches wide. Each vertical panel attachment slot 217 is configured so that when the inner edge 219 of the middle vertical panel 210 is inserted it is perpendicular to the face of the vertical panel front 211 to which it is attached so that all four vertical panels can be attached, as show in FIG. 8. In one embodiment the slots and attachment edges are precisely cut so that the edges (219, 319, 419) snap fit securely into the attachment slots 217, 317, or 417. In an alternate embodiment the edges are glued or attached by common adhesives.

Figure 8:
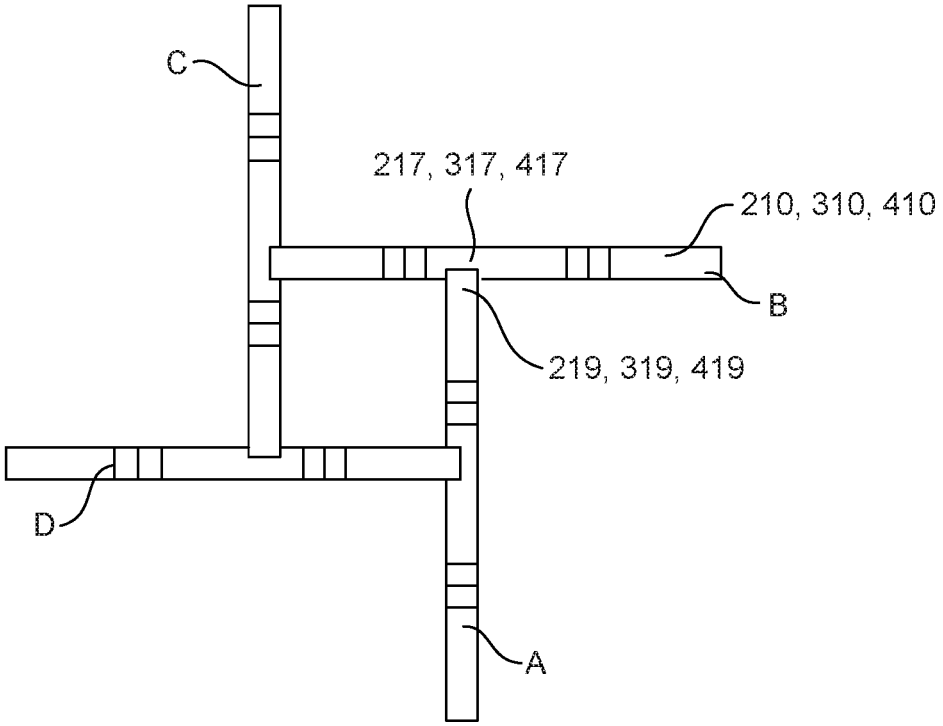
FIG. 8 is a top view of the four vertical panels as attached.

As seen in FIG. 8, the inner edge 219 is inserted into the vertical attachment slot 217, and all for inner edges 219 are inserted into the four vertical slots 217 so that the four vertical panels are attached in an offset cross pattern, with a square interior and with the ends of the panels extending from the square. (Note that FIG. 8 only has one paired set of slots 271, 317, 417 and edges 219, 319, 419 labeled for simplicity.) There are four vertical panels in each section, so four top section vertical panels 210, four middle section vertical panels 310, and four bottom section vertical panels 410. As shown in FIG. 8, the four vertical panels are labeled A, B, C, and D. The attachment edge of A (219, 319, 419) is inserted into the attachment slot of B (217, 317, 417), attachment edge of B (219, 319, 419) is inserted into the attachment slot of C (217, 317, 417), attachment edge of C (219, 319, 419) is inserted into the attachment slot of D (217, 317, 417), and the attachment edge of D (219, 319, 419) is inserted into the attachment slot of A (217, 317, 417), to create the offset cross pattern with a square interior as shown from above in FIG. 8. FIG. 8 shows the edges 219, 319, 419 as the same thickness as the entire panel and so also shows the slots 217, 317, 417 as that width, but as noted the edges can be thinner and the slots will be correspondingly thinner. As the vertical panels 210 are being assembled, the bin bases 50 are also inserted into the respective bin base slots 215, and the completed top section 200 appears as in FIG. 5. When assembled, the four vertical panels 210 and the eight bin bases 50 create two levels of four display bins 107 on a four-sided section. Note that the attachment of the vertical panels is the same for the middle section 300 and the bottom section 400. As noted above the attachment slots and bin base slots can be sized to accommodate the attachment edges, and can be the width of the panel, or in alternate embodiments the edges can be cut to size and be smaller than the panels and the slots sized accordingly. The edges can be snap fit into the slots, or adhered by adhesive.

Figure 6:
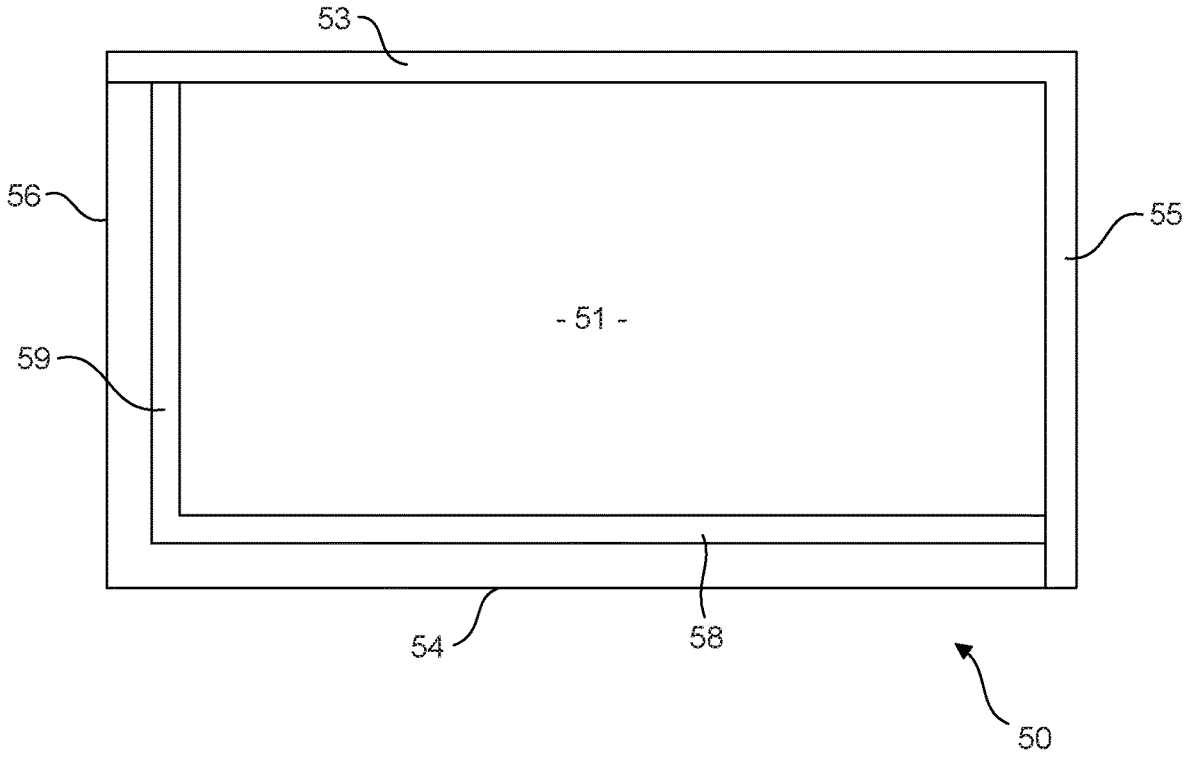
FIG. 6 is a top view of the bin base.
Figure 7:
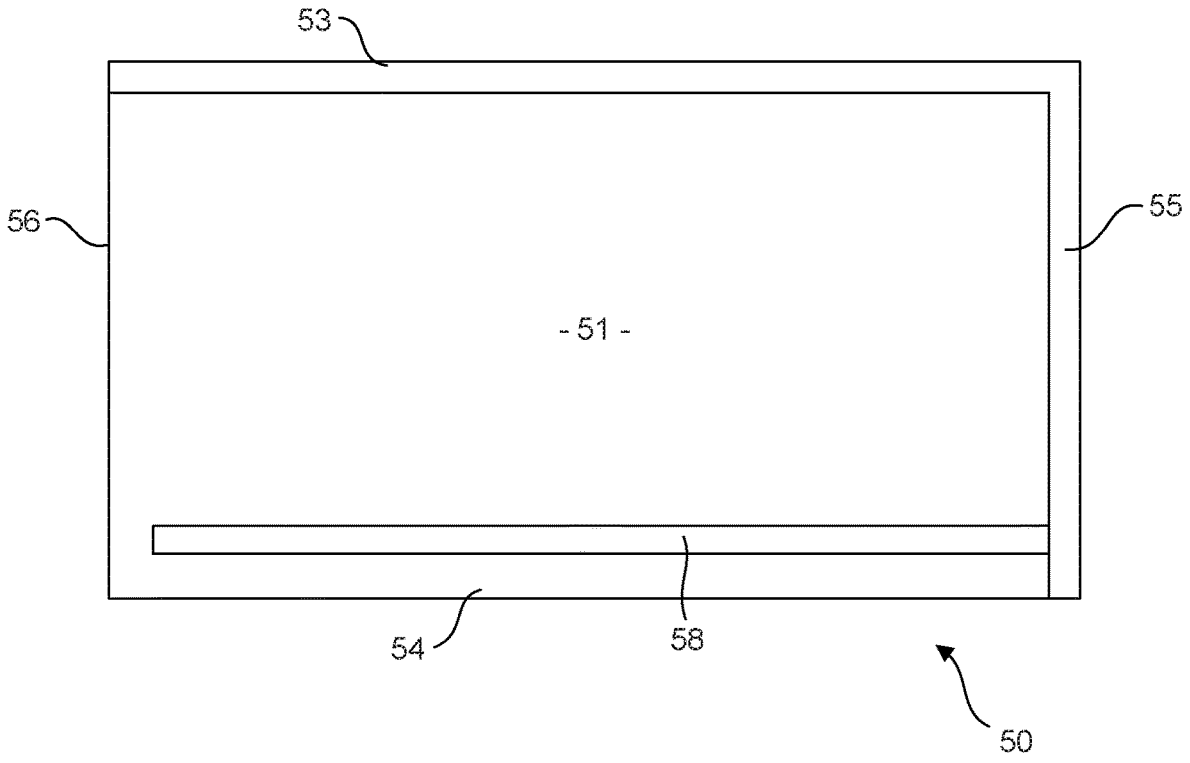
FIG. 7 is a bottom view of the bin base.

The bin base 50 has a bin base bottom 51 shown in FIG. 6, and a bin base top 52 shown in FIG. 7. Each Bin Base 50 has a Bin Base bottom 51 (which becomes the bottom surface of the actual display bin 107), a Bin Base top 52 (which is the top of the actual bin), a Bin Base attached side 53 (which is the long side and which is inserted into one of the bin base slots 215, 315, 415), a bin base attached end 55 (which is the short side and which is inserted into the other bin base slots 215, 315, 415), a bin Base exposed side 54 (which is the long outside side of the bin base 50), and a Bin Base exposed end 56, which is at the front of the display bin 107. Each bin base 50 also has a Bin Base outside top groove 57, which is cut into the bin base top 52 parallel to and just inset about a quarter of an inch from the bin base exposed side 54. There is a bin base outside bottom groove 58 which is cut into the bin base bottom 51 parallel to and just inset about a quarter of an inch from the bin base exposed side 54. The top groove 57 and bottom groove 58 are wide enough to accommodate the slot side cover 80, which is typically $1/8^{th}$ or $1/16^{th}$ of an inch thick, and are the length of the slot side cover 80, and approximately one-quarter of an inch deep. When the sections are assembled the bin base outside top groove 57 will be directly above the bin base outside bottom groove 58 so that the side cover 80 can be inserted therein. Once the section is assembled, and the bin base top 52 is above the bin base bottom 51, the side cover 80 is attached by sliding into the top groove 57, which is deep enough to allow the side cover 80 to be slid over and dropped into the bottom groove 58. Slot side covers 80 are made of plastic or plexiglass, and are typically one-eighth or one-sixteenth of an inch thick. They are designed to hold the contents of the slot in place, and are also used to show what is within the slots. Since they are plastic, and since the common contents of the display bins 107 are stickers or decals, the stickers or decals can be place on the side of the slot cover 80, so the consumer knows that is in the display bin 107.

There is a bin base lip groove 59, located on the bin base bottom 51 near exposed end 56. In FIG. 6 the bottom groove 58 is shown as connecting with the lip groove 59, but in some embodiments they are separate. In some embodiments the lip groove 59 is the same length as the display lip 90. There is a display lip 90 that sits at the front of each display bin 107 to keep the contents of the bin 107 in place. In the preferred embodiment the display case 100 is used to display decals for sale, and the decals are in a plastic display sleeve that sits inside the display bin 107. The display lip 90 is about an inch high so is high enough to keep the contents within the bin, but low enough so that a purchaser can easily remove the contents from the display slot 107. The lip 90 is also nearly as wide as the bin base exposed end 56. In the preferred embodiment the display lip 90 is made of plastic and is typically one-eight or one-sixteenth of an inch thick. In one embodiment the bin base lip groove 59 is sized to allow the display lip 90 to snap fit securely in place, while in another embodiment the display lip 90 is glued in place.

Figure 9:
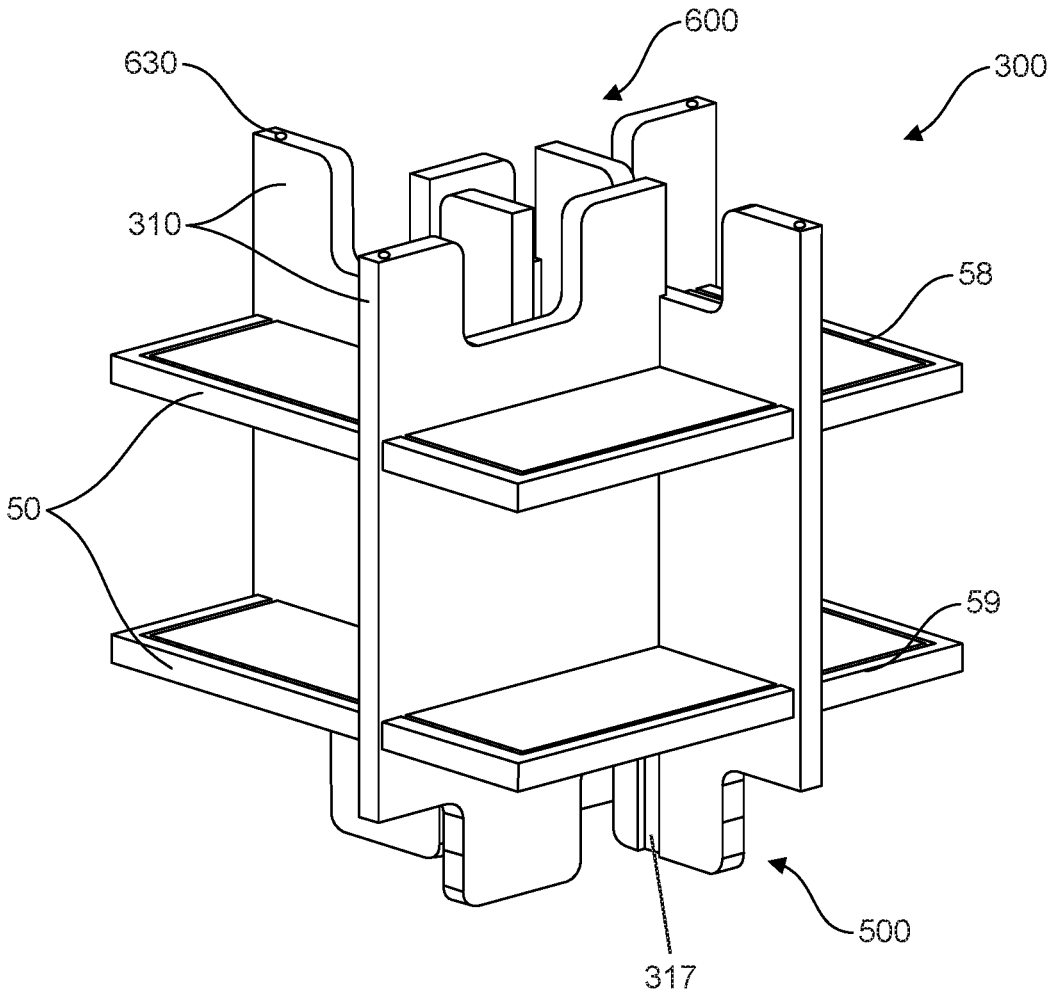
FIG. 9 is a perspective view of the middle section of the display case.
Figure 10:
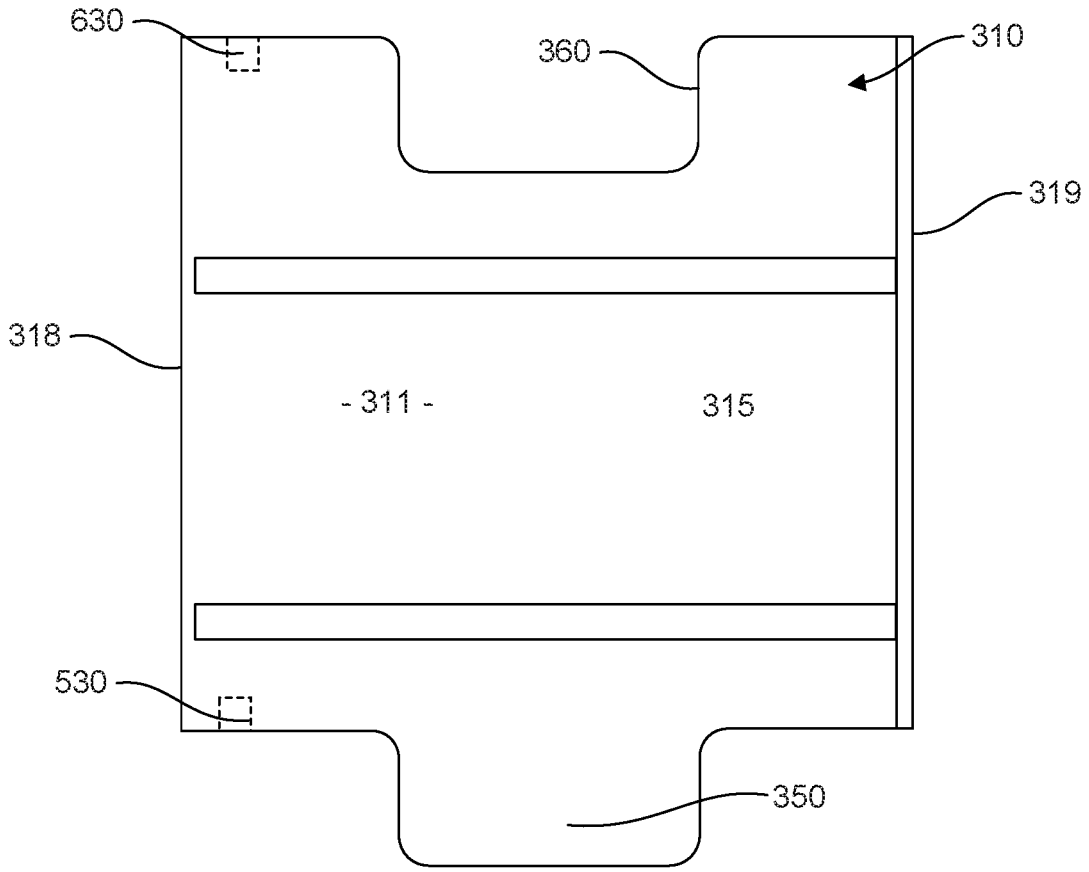
FIG. 10 is a plan view of the front of the middle vertical panel.
Figure 11:
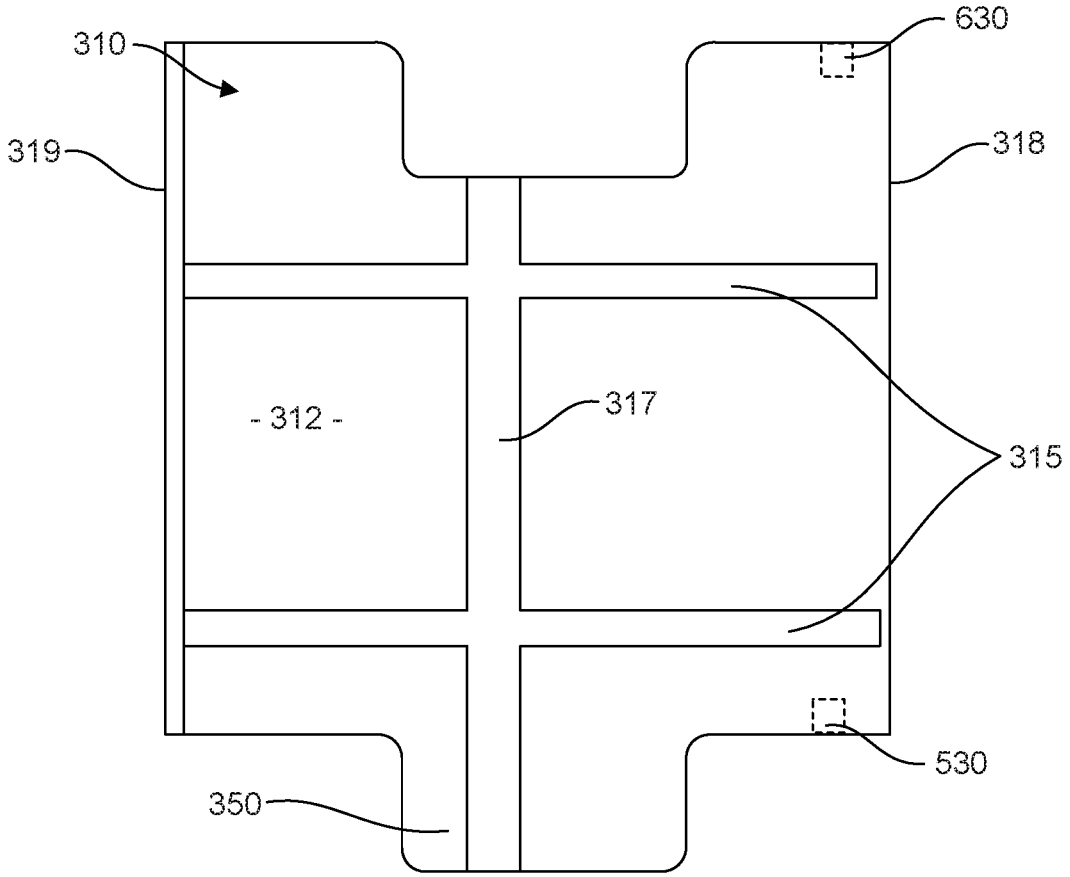
FIG. 11 is a plan view of the rear of the middle vertical panel.

The middle section 300 is constructed by connecting four middle vertical panels 310 and eight bin bases 50, in the same way as the top section 200 which was described in detail above. The middle vertical panels 310 are the same width as the top section vertical panels 210, and as the bottom section vertical panels 410, with the vertical attachment slots 217, 317, and 417 located in the same position on the vertical panels 210, 310, and 410, and the attachment edges 219, 319, 419, aligned and having the same thickness. FIG. 9 shows the middle section 300 in a perspective view, FIG. 10 shows the front 311 of the panel 310 and FIG. 11 shows the rear 312 of the panel 310. The four middle vertical panels 310 each have a vertical panel front 311 and a vertical panel back 312, a vertical panel top 360 that is the same as the panel tops 460 of the bottom section, and which are part of the uniform top attachment 600, a vertical panel bottom 350 that is the same as the panel bottom 250 of the top section, and this is part of the uniform bottom attachment 500. Each middle vertical panel 310 also has a middle vertical panel outside edge 318 and a vertical panel inside edge 319. It is the vertical panel inside edge 319 that is inserted into the vertical panel attachment slot 317.

The vertical panel front 311 has two bin base slots 315 that are parallel with each other and are perpendicular to the sides of the vertical panel 310 so that when the bin bases 50 are attached they create bins 107 for holding the articles to be displayed, wherein the bins 107 are essentially horizontal. The bin base slots 315 are cut one quarter inch into the vertical panels 310, and sized appropriately to accommodate the bin base attachment edge 53 as described elsewhere herein. The vertical panel back 312 also has two bin base slots 315 that correspond to the bin base slots 315 on the front of the component. The vertical panel back 312 also has a vertical panel attachment slot 317 that runs vertically down the entire height of the vertical panel 310, and is aligned with the other vertical panel slots 217 and 417, as described herein. The vertical panel attachment slot 317 is sized to accommodate an inserted vertical panel inside edge 319, as described elsewhere herein and one quarter inch deep to securely attach the component. The vertical panel attachment slot 317 is offset from the middle or centerline of the middle vertical panel 310, in precisely the same manner and same geometry as the top section vertical panels 210 and the bottom section vertical panels 410 so that all of the vertical panels 210, 310, 410 are aligned. Each vertical panel attachment slot 317 is configured so that when the middle vertical panel 310 is inserted it is perpendicular to the face of the vertical panel front 311 so that all four vertical panels can be attached, as show in FIG. 8. As the vertical panels 310 are being assembled, the bin bases 50 are also inserted into the respective bin base slots 315. The middle vertical panel also has a top dowel hole 530 on the top 360 at the outside edge 318 and a bottom dowel hole 630 on the bottom 350 at the outside edge 318.

To construct one of the middle sections 300, four vertical panels 310 are attached. The inside edge 319 of each vertical panel 310 is inserted into the panel attachment slots 317. At the same time as the four panels 310 are being attached, eight bin bases 50 are also attached, two on each side (as shown in the perspective view), in the same manner as described above for the top section 210. The bin base attached end 55 is inserted into the short component of the bin base slot 315 of one panel 310, while the bin base attached side 53 is inserted into the long component of the base slot 315. In one embodiment the four vertical panels 310 and eight bin bases 50 are designed and manufactured such that the inside edges 319 fit snugly into the panel attachment slots 317 and the bin base attached side 53 and attached end 55 fit snugly into the bin base slots 315, and the fact that the four panels are attached perpendicularly (as shown in the top and perspective views), and the bin bases 50 are also attached perpendicularly prevents any one from pulling out of the other and holds the middle section 300 together. In another embodiment the four vertical panels 310 and eight bin bases 50 are attached by means of glue or other well known and commercially available adhesive.

Figure 12:
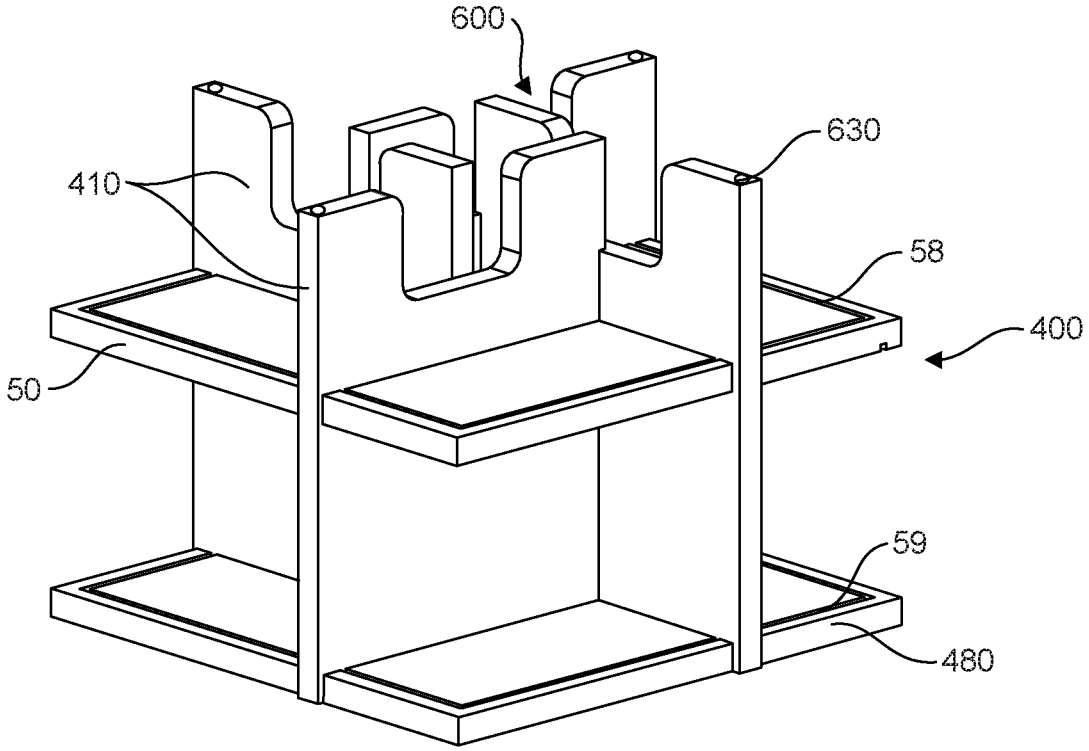
FIG. 12 is a perspective view of the bottom section of the display case.
Figure 13:
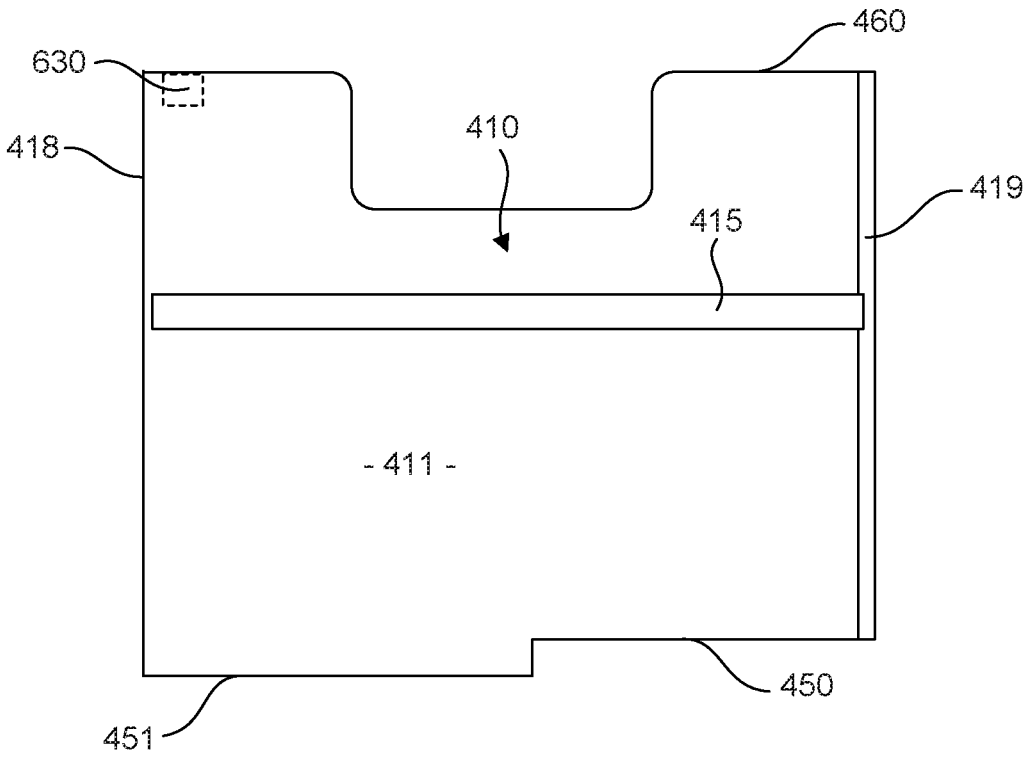
FIG. 13 is a plan view of the front of the bottom vertical panel.
Figure 14:
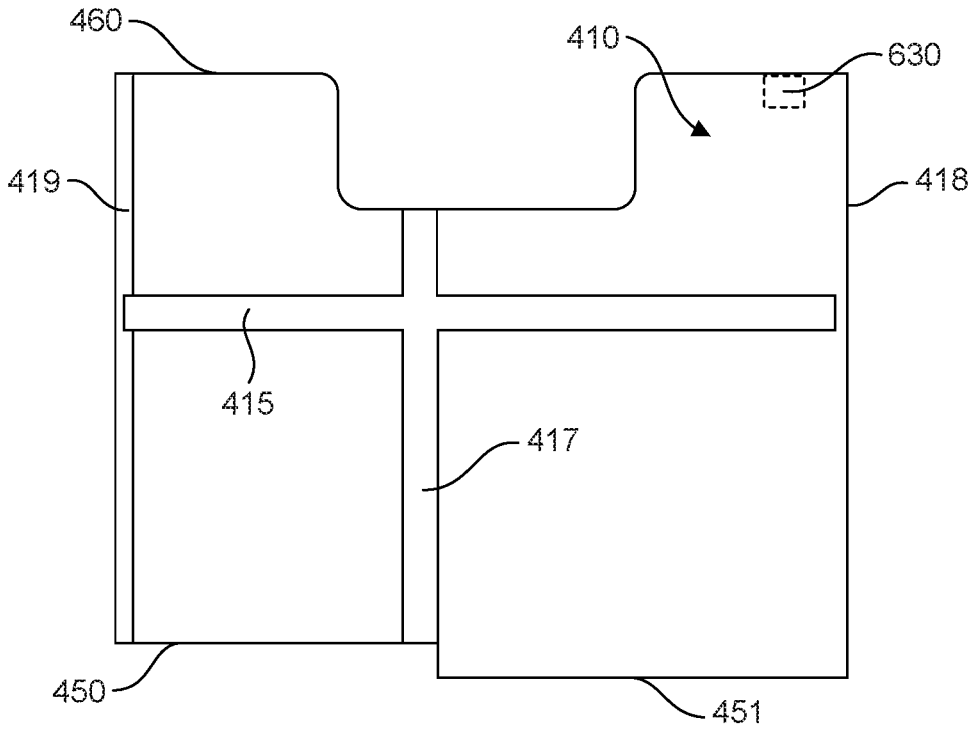
FIG. 14 is a plan view of the rear of the bottom vertical panel.

The bottom section 400 is shown in perspective view in FIG. 12, the front view in FIG. 13, and the rear view in FIG. 14. The bottom section 400 is constructed by connecting four bottom vertical panels 410, four bin bases 50, and bottom section bottom shelf 480, in the same manner and geometry as the top section 200 and the middle section 300, as described in detail above, so that the bottom section 400 can be attached to either the middle section 300 or the top section 200. Four bottom vertical panels 410, each have a vertical panel front 411 and a vertical panel back 412, a vertical panel top 460 that is part of the uniform top attachment 600, and a unique a bottom vertical panel bottom 450 with an attachment extension 451. Each bottom vertical panel 410 also has a bottom vertical panel outside edge 418 and a vertical panel inside edge 419. It is the vertical panel inside edge 419 that is inserted into the vertical panel attachment slot 417. The bottom shelf 480 includes four attachment slots 483 that are aligned with the vertical panel bottom attachment extension 451 and sized to accommodate and attach thereto, in the same manner as the top shelf 220 attaches to the top section vertical panels 210.

The vertical panel front 411 has one bin base slot 415 that is perpendicular to the sides of the vertical panel 410 and parallel to the bottom shelf and when attached parallel to all of the other bin bases 50 so that when the bin bases 50 are attached they create bins 107 for holding the articles to be displayed, wherein the bins 107 are essentially horizontal. The bin base slots 415 are cut one quarter inch into the vertical panels 410, and are one half inch wide to snugly accommodate the bin base 50, or as needed based on the attachment edges 53 and 55 as described in detail above.

The vertical panel back 412 also has one bin base slot 415 that correspond to the bin base slot 415 on the front 411 of the vertical panel 410. The vertical panel back 412 also has a vertical panel attachment slot 417 that runs vertically down the vertical panel 410. The vertical panel attachment slot 417 is sized to accommodate an inserted vertical panel inside edge 419 as described in detail above, and one quarter inch deep to securely attach the component. The vertical panel attachment slot 417 is offset from the middle or centerline of the middle vertical panel 410 in the same manner and in the same geometry as the other attachment slots 217 and 317 described above. Each vertical panel attachment slot 417 is configured so that when the middle vertical panel 410 is inserted it is perpendicular to the face of the vertical panel front 411 so that all four vertical panels can be attached, as show in FIG. 8. As the vertical panels 410 are being assembled, the bin bases 50 are also inserted into the respective bin base slots 415. The bottom vertical panels 410 also have top dowel holes 630 on the top 460 located at the outside edge 418.

Figure 16:
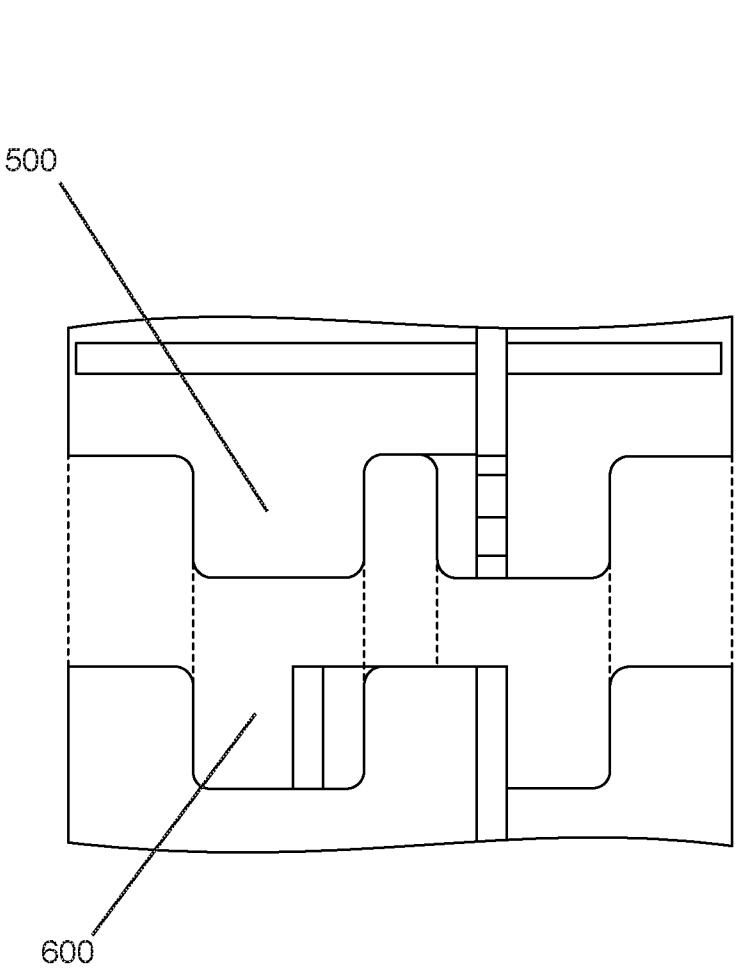
FIG. 16 is a side view of the uniform bottom attachment in position to be attached to the uniform top attachment.
Figure 15:
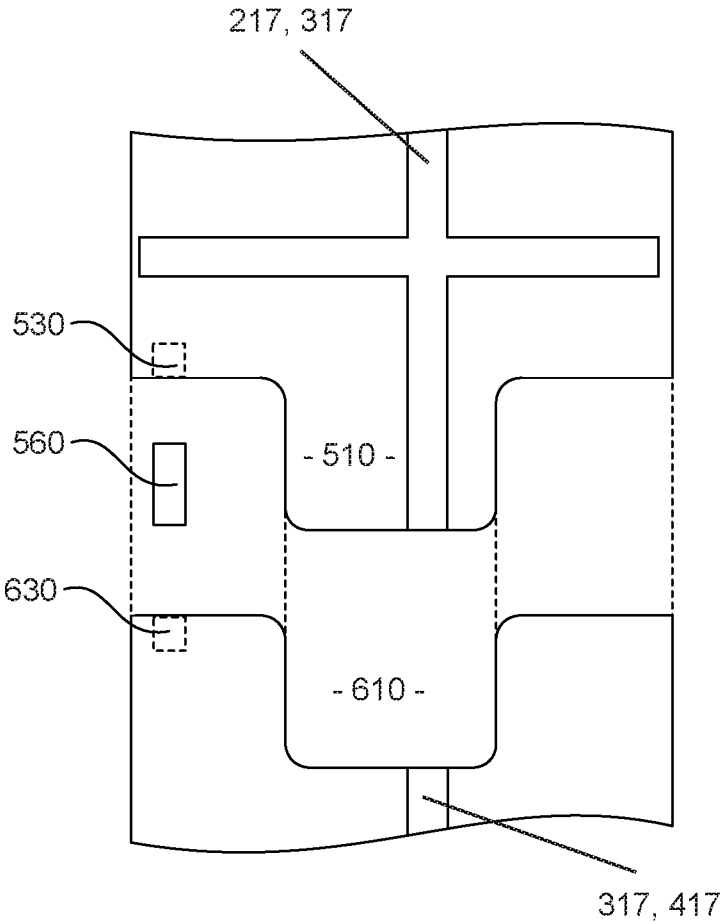
FIG. 15 is a view of the protruding tongue to be inserted into the groove.
Figure 17:
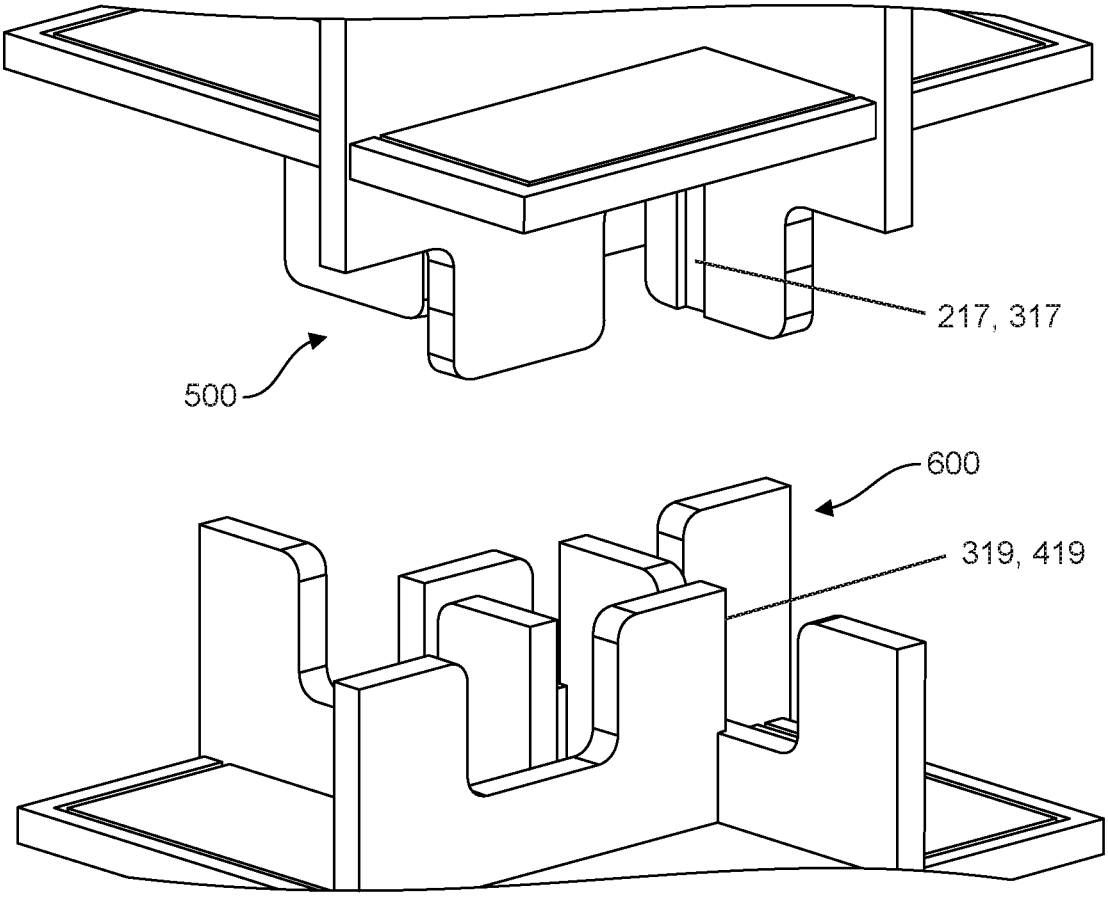
FIG. 17 is perspective view of the uniform bottom attachment in position to be attached to the uniform top attachment.

Each top section vertical panel 210 has a vertical panel bottom 250 that is part of the uniform bottom attachment 500. Each middle section vertical panel 310 has a vertical panel top 360 that is part of the uniform top attachment 600, and a vertical panel bottom 350 that is part of the uniform bottom attachment 500. Each bottom section vertical panel 410 has a vertical panel top 460 that is part of the uniform top attachment 600. The display case 100 is designed and configures such that the top, middle, and bottom sections fit together by means of the uniform bottom attachment 500 fitting into the uniform top attachment 600. As seen in FIG. 15, FIG. 16 and FIG. 17, the uniform bottom attachment 500 consists of the four "D" shaped bottom tongues 510 that protrudes down from each of the bottom edges 520, and are set in an offset cross pattern with an internal square as described above. As can be seen in FIG. 15, the bottom tongue 510 sits in the middle of the vertical panel 210 or 310. In the preferred embodiment the vertical panel 210, 310, and 410 is sixteen inches wide, the tongue 510 is six inches wide, and the bottom edges 520 on either side of the tongue are five inches wide, and the tongue 510 is five inches long. The uniform top attachment 600 consists of the four top edge 620 and the four "U" shaped grooves 610 that are cut into the top edges 620, and are set in an offset cross section pattern. The groove 610 is six inches wide and five inches deep. The tongue 510 is sized, shaped, and configured to fit snuggly and securely into the groove 610. In the preferred embodiment the edges of the tongue 510 and groove 610 are slightly rounded, as seen in FIG. 15.

The four vertical panels 210, 310 or 410 are attached, as described above, in an offset cross pattern with a center square with the cross arms extending from the sides of the square, as shown in FIG. 8. As seen in the side view of FIG. 16 and the perspective view of FIG. 17, the underside attachment 500 consists of the bottoms 250 or 350 of the four vertical panels 210 or 310, which primarily includes the downwardly extending "D" shaped tongue 510. The four panels are attached in the offset cross patterns, and each section has the same identical offset cross pattern so that each section can be attached to the section below it by lowering the upper section down so that the four downwardly extending "D" shaped tongues 510 insert into the top "U" shaped groove 610, as shown in FIG. 15. The offset cross pattern means that each panel is offset and so provides stability when all are attached. Slots 217 and 317 run the entire length of the panels 210 and 310 and so down to the bottom 250 and 350, and when the sections are attached the inside edge 319 or 419 of the section below fits into the slots 217 or 317, as best seen in FIG. 17. Because of the offset cross pattern and the interior square shape, the four inside edges 319 and/or 419 fitting into the four slots 217 and/or 417 holds the components into place and ensure a good fit and stability.

In one embodiment there are bottom dowel holes 530 that are drilled into the vertical panels on the bottom edge 520, and top dowel holes 630 drilled into the vertical panels on the top edge 620 adjacent the outside edges 218, 318, and 418, as shown in FIG. 15. The top and bottom dowel holes 630 and 530 are offset about half an inch from the outside edges 218, 318, and 418 and are aligned so that a dowel 560 can be inserted into both when the components are attached. The dowel holes 530 and 630 are sized to accommodate a dowel 560, and are typically about one-eight of an inch in diameter, and about half an inch deep. There is a dowel 560 that is placed in the bottom dowel hole 530. The top dowel holes 630 and bottom dowel holes 530 are configured to align so that the dowel 560 can be inserted to align the sections as they are attached. The dowels 560 help with alignment and stability.

The present invention is well adapted to carry out the objectives and attain both the ends and the advantages mentioned, as well as other benefits inherent therein. While the present invention has been depicted, described, and is defined by reference to particular embodiments of the invention, such reference does not imply a limitation to the invention, and no such limitation is to be inferred. The depicted and described embodiments of the invention are exemplary only, and are not exhaustive of the scope of the invention. Consequently, the present invention is intended to be limited only be the spirit and scope of the claims, giving full cognizance to equivalents in all respects.

We claim:

1. A stacking display case comprising:

a bottom section comprised of four vertical panels, each of one of four vertical panels has an inside edge and an attachment slot offset from a midpoint of the vertical panel, wherein the inside edge of each of the one of four vertical panels is attached perpendicularly into the attachment slot of another of the four vertical panels such that they create an offset cross pattern, and wherein further each of said for vertical panels has a top end and a bottom end and wherein each top end is the same to create a uniform top end and wherein each bottom end is the same to create a uniform bottom end, and wherein further the four top ends in combination create a uniform top attachment;

a middle section comprised four vertical panels, each of one of four vertical panels has an inside edge and an attachment slot offset from a midpoint of the vertical panel, wherein the inside edge of each of the one of four vertical panels is attached perpendicularly into the attachment slot of another of the four vertical panels such that they create an offset cross pattern, and wherein further each of said for vertical panels has a top end and a bottom end and wherein each top end is the same to create a uniform top end and wherein each bottom end is the same to create a uniform bottom end, and wherein further the four top ends in combination create a uniform top attachment, and the four bottom ends in combination create a uniform bottom attachment;

a top section comprised of four vertical panels, each of one of four vertical panels has an inside edge and an attachment slot offset from a midpoint of the vertical panel, wherein the inside edge of each of the one of four vertical panels is attached perpendicularly into the attachment slot of another of the four vertical panels such that they create an offset cross pattern, and wherein further each of said for vertical panels has a top end and a bottom end and wherein each top end is the same to create a uniform top end and wherein each bottom end is the same to create a uniform bottom end, and wherein further the four bottom ends in combination create a uniform bottom attachment;

wherein the bottom section offset cross pattern, the middle section offset cross pattern, and the top section offset cross pattern are identical such that the middle section can attach to the bottom section and the top section can attach to either the middle section or the bottom section.

2. The stacking display case of claim 1 wherein the uniform bottom attachment of said middle section and the uniform bottom attachment of said top section are identical, and wherein the uniform top attachment of said bottom section and the uniform top attachment of said middle section are identical, such that said top section and can attach directly to said bottom section to create a four bin level display case, or wherein said middle section can be attached to said bottom section and said top section can be attached to said middle section to create a twelve bin level display case.

3. The stacking display case of claim 2 wherein further additional middle sections can be added to create much taller display cases.

4. The stacking display case of claim 1 wherein further the bottom section vertical panel top end and the middle section vertical panel top end are the same, wherein both consist of a "U" shaped groove cut into said top end, wherein said "U" shaped groove is cut into the center of said panel;

and wherein further the top section vertical panel bottom end and the middle section vertical panel bottom end are the same, wherein both consist of a "D" shaped tongue protruding from said bottom end, wherein said "D" shaped tongue is in the center of said panel;

and wherein further said "D" shaped tongue is configured to fit into said "U" shaped groove.

5. The stacking display case of claim 4 wherein the four combined top ends with "U" shaped grooves create a uniform top attachment, and wherein said four combined bottom ends with "D" shaped tongues create a uniform bottom attachment, and wherein further any uniform bottom attachment can attach to any uniform top attachment to hold the components securely together.

6. The stacking display case of claim 5 wherein the vertical panel attachment slots run the entire length of the vertical panels such that when one section is attached to another section the inside edge of the vertical panel below attaches into the attachment slot of the vertical panel above.

7. The stacking display case of claim 4 wherein further there is a dowel hole drilled in the outside end of each of the vertical panels such that the top end and bottom end align, and wherein further an appropriately sized dowel is inserted into said dowel holes to align the attached components.

8. A stacking quick assembly display case comprising:

a four-sided bottom section having a uniform top attachment;

a multiplicity of four-sided middle sections having a uniform bottom attachment and a uniform top attachment;

a four-sided top section having a uniform bottom attachment;

wherein said bottom section, said middle sections, and said top section are constructed from four vertical panels attached on a perpendicular edge and offset from the middle of said vertical panel to create an offset cross pattern with an interior square;

wherein said uniform top attachment mates with said uniform bottom attachment;

and wherein further said top section can be attached directly to said bottom section, or to one or more middle sections to create a stacking display case of varying heights.

9. The stacking quick assembly display case of claim 8 wherein said uniform bottom attachment includes four downwardly protruding tongues, and wherein said uniform top attachment includes four grooves, and wherein further said downwardly protruding tongues mate with said grooves to allow the sections to attach.

* * * * *